US005238316A

United States Patent [19]

Moore et al.

[11] Patent Number: 5,238,316

[45] Date of Patent: Aug. 24, 1993

[54] PRINTER PAPER COLLECTION STRUCTURE

[75] Inventors: Ernest R. Moore; Lorraine Moore, both of Cameron; Wallace R. Currie, Dallas, all of Tex.

[73] Assignee: Balt, Inc., Cameron, Tex.

[21] Appl. No.: 839,113

[22] Filed: Feb. 20, 1992

[51] Int. Cl.[5] ..... B41J 11/58

[52] U.S. Cl. ..... 400/613.2; 400/619; 400/613; 493/410

[58] Field of Search ..... 400/611, 619, 613, 613.2, 400/613.3; 211/50, 51; 271/207, 220; 493/410, 448

[56] References Cited

U.S. PATENT DOCUMENTS

| | | | |
|---|---|---|---|
| D. 295,984 | 5/1988 | Currie | D18/23 |
| D. 307,084 | 4/1990 | Currie | D6/464 |
| 4,707,156 | 11/1987 | Clark | 400/613.2 |
| 4,722,506 | 2/1988 | Chang | 400/613.2 |
| 5,028,154 | 7/1991 | Cull | 400/613.2 |
| 5,074,543 | 12/1991 | Lawniczak et al. | 271/207 |
| 5,074,837 | 12/1991 | Blanton III, et al. | 493/410 |
| 5,123,893 | 6/1992 | Grooms | 493/410 |

FOREIGN PATENT DOCUMENTS

| | | | |
|---|---|---|---|
| 3027190 | 2/1982 | Fed. Rep. of Germany | 400/613.2 |

OTHER PUBLICATIONS

Printer Collection Structure Sketch.

*Primary Examiner*—Edgar S. Burr
*Assistant Examiner*—Lynn D. Hendrickson
*Attorney, Agent, or Firm*—Johnson & Gibbs

[57] ABSTRACT

A computer paper printer collection basket constructed with an adjustable bar facilitating the automatic folding of continuous feed printer paper thereacross during the discharge thereof for purposes of stacking. The printer basket may formed with or separately from a discharge area of a conventional printer and disposed immediately therebeneath. The adjustable bar's position to intercept the paper intermediate the fold lines thereof. In this manner, the printer paper will automatically fold thereacross during the collection thereof.

9 Claims, 2 Drawing Sheets

PRINTER PAPER COLLECTION STRUCTURE

BACKGROUND OF THE INVENTION

1. Field of the Invention

The present invention relates to printer paper collection baskets and, more particularly, to a continuous feed printer paper collection basket adapted for automatically stacking the continuous feed paper therein.

2. History of the Prior Art

The advent of the computer and continuous feed paper for use therewith has revolutionized the business world. Today reams of paper are produced by continuous feed printers and are collected adjacent the printer for subsequent review, analysis or other uses. Although such uses often require separation of individual sections of the continuous feed paper, the advantages of a continuous feed discharge process are widely accepted and appreciated. Sequential pages from the printer are collected in an organized fashion and may be handled and transported without concern for misjoinder of pages. Of course the most advantageous aspect of the continuous feed discharge is the fact that paper may be fed into the printer and received from the printer with a minimum of handling and a high degree of reliability as to both the feed and the discharge relative thereto.

Paper which is being fed into a continuous feed and discharge printer is easily controlled. The paper comes from a pre-arranged folded stack and few problems, if any, result from the transfer of said paper from the paper feed area. The same cannot be said in all instances for the collection end. When printer paper is discharged from the printer it has been, by definition, unfolded, and it may or may not have a tendency to properly fold itself back upon discharge from the printing unit. In many instances boxes or baskets are simply placed in a region below the printer discharge area for collection, and the printer paper is simply allowed to collect and fold upon itself therein. Misalignment of the collection basket relative to the printer, interruptions in the operation of the printer and/or mishandling of the discharged paper itself can lead to irregularities in the folding process. Any of these events can result in a disorganized array of continuous feed paper received within conventional basket areas. It would be an advantage, therefore, to provide a collection basket that virtually assures the proper folding of the continuous feed printer paper across the perforated sides thereof following discharge from the printer to facilitate proper stacking and organization thereof.

The present invention addresses such improved printer paper collection systems by providing a basket which may be integrally formed with, or disposed adjacent to, a continuous feed printer stand for the collection of paper therefrom. The improved collection structure includes adjustable side walls and an adjustable breaker bar which engages the printer paper during the discharge from the printer to ensure the proper folded configuration thereacross. In this manner physical interruptions of the printer paper itself will not adversely effect the organized folding and stacking of the discharged paper. Maximum effectiveness of the continuous feed system can then be realized.

SUMMARY OF THE INVENTION

The present invention relates to a continuous feed paper collection basket having means formed therewith for passive folding of the paper therein. More particularly, one aspect of the invention comprises a continuous feed printer paper basket adapted for positioning adjacent a continuous feed printer for the collection of paper therefrom, which basket includes a breaker bar adjustably mounted therein for positioning intermediately thereof to receive the continuous feed paper thereupon. The breaker bar causes an arcuate roll to be formed upon the received paper. The breaker bar produces an arch upon the paper received within the basket which arch is supported by the breaker bar and further induces adjacent layers of continuous feed paper to fold thereupon in sequentially induced folding steps commensurate with the organized stacking of the printer paper. The basket may be formed integrally with the printer stand or may be separately constructed for positioning adjacent thereto. In either configuration, the size and shape of the basket may be adjusted in conjunction with the breaker bar for facilitating utilization with various continuous feed paper sizes and preferential folding configurations thereof.

In yet another embodiment, the above described collection basket further includes a paper chute disposed adjacent the printer platform and angled downwardly toward the base. A tray assembly is disposed relative to a leg assembly and beneath the paper chute for collecting the paper from the chute. The leg assembly may be part of, or separate from, the printer stand. Means are disposed within the tray for inducing the paper to fold upon itself and stack therein. The folding means may comprise at least one bar adjustably mounted within the tray for select positioning relative to the leg assembly and beneath the platform. The bar may also be supported on opposite ends by adjustable linkage affording height and lateral position adjustment thereof.

In another aspect, the above described invention includes the adjustable linkage having first and second slotted arms, the arms being pivotally engaged one to the other on a first end and opposite ends of the first and second arms being pivotally secured to laterally disposed portions of the leg assembly of either the printer stand or the basket itself.

In yet another aspect, the invention includes an improved printer paper collection basket of the type wherein a container is disposed beneath a continuous feed paper printer platform for receipt of paper discharged therefrom, the improvement comprising first and second upstanding walls adjustably disposed one to the other for facilitating the size of paper to be received from the printer and means disposed between the adjustable walls for inducing the paper to fold upon itself and stack therein. The folding means may comprise at least one bar adjustably mounted between the walls for select positioning relative thereto and beneath the platform. The bar may also be supported on opposite ends by adjustable linkage affording height and lateral position adjustable thereof, and the linkage may comprise first and second slotted arms, the arms being pivotedly engaged one to the other on a first end of each with opposite ends of the first and second arms being pivotedly secured to laterally disposed portions of the basket.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
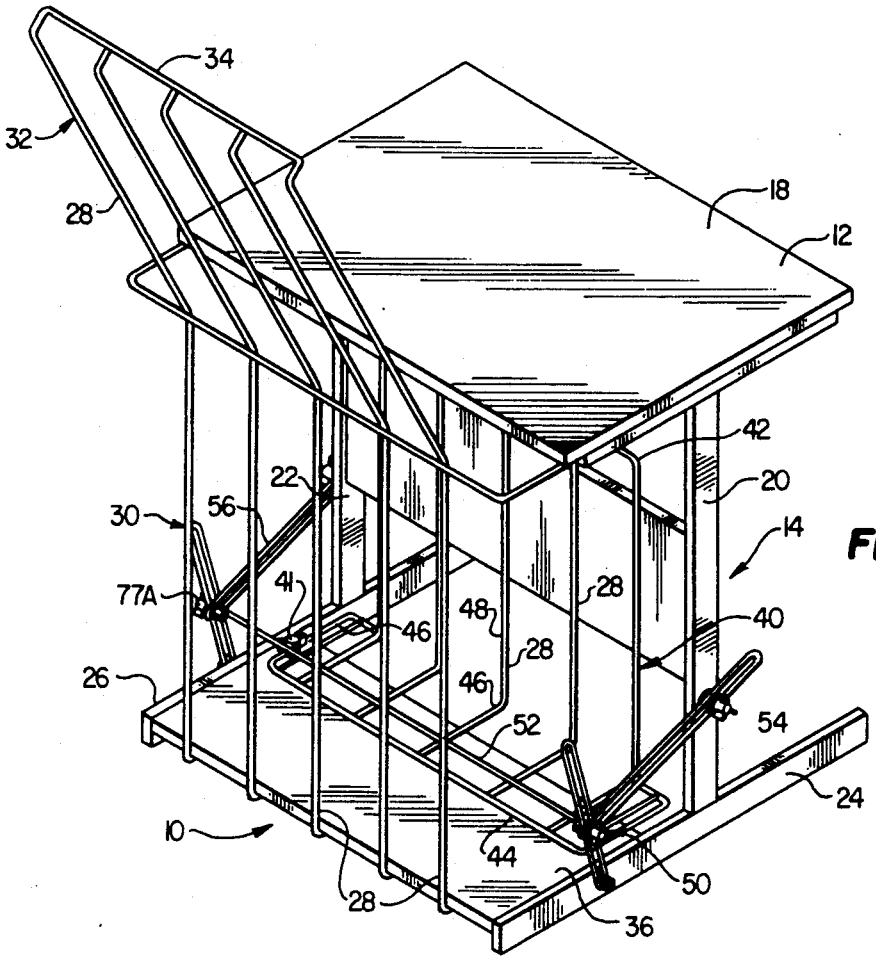
FIG. 1 is a perspective view of a printer paper collection structure constructed in accordance with the principles of the present invention and integrally formed with a printer stand illustrating the receipt of continuous feed paper therein.

Referring first to FIG. 1, there is shown a perspective view of a continuous paper feed printer stand and paper collection basket, integrally formed therewith, constructed in accordance with the principles of the present invention. The collection basket 10 is connected to the printer stand 12 in the lower region 14 thereof. With this particular assembly, effective and improved paper stacking is provided with enhanced stacking features capable of handling an entire box of any type of continuous feed forms or labels with an assembly that will adjust both height and depth positioning to assure proper refolding of such continuous feed paper as described below.

Still referring to FIG. 1, the printer stand 12 includes a platform 18 supported by vertical legs 20 and 22, which legs are each secured to underlying, horizontal base members 24 and 26, respectively. The base members 24 and 26 provide the necessary balance to the platform 18 for the placement of a conventional printer thereon. The platform 18 has an end surface for positioning behind the printer to provide means for passing continuous feed printer paper discharged from the printer downwardly toward the collection basket 10. The collection basket 10, described above, is then assembled between the legs 20 and 22 and base members 24 and 26 outwardly therefrom and in a configuration beneath platform 18 to thereby effectively receive, guide and refold continuous feed paper in a manner most efficiently handled and adaptable to a variety of printers and types of continuous feed paper. In this configuration, the collection basket 10 includes a plurality of upstanding wire members 28 which form a paper chute comprising a rear wall 30 of the collection basket 10. The rear wall panel 30 continues upwardly beyond the platform 18 with angulated wall section 32 likewise comprised of extended, angulated wire members 28. In this embodiment the rear wall 30 is stationary. The wire members 28 are joined across the upper region by top wire member 34 to effectively provide an end piece and structural integrity thereto. The lower region of the collection basket 10 includes a tray or floor panel 36 adapted for receiving the continuously fed paper thereupon.

The collection basket 10 further includes a frontal wall panel 40 likewise comprised of a plurality of wire members 28 formed in an angular orientation and upstanding from floor panel 36 in a moveable, adjustable configuration. Wire members 28 of panel 40 are connected across the top most region by a wire section 42 and are connected across the floor panel 36 by wire 44. Each of the vertical wire members 28 of panel 40 are constructed in an angular configuration with each wire member 28 of panel 40 having a first base section 46 formed at right angle to an upstanding wall section 48. This particular assembly then provides an adjustable wall for the alignment and containment of varying sizes of foldable paper.

Still addressing to the frontal panel wall 40, the adjustability thereof is provided by locking or coupling members 41 upstanding from the base panel 36. The locking members 41 are, in this particular embodiment, conventional threaded fasteners that may be loosened and tightened about selected wire members 46 that form the above described base section of frontal wall 40. Although a threaded adjustment is shown herein any conventional form of a demountable coupling would be in accordance with the principles of the present invention.

Referring still to FIG. 1, the key to properly folding continuous feed paper into the basket area that is adjustably positioned by the front wall 40 is breaker bar assembly 50. Breaker bar assembly 50 includes elongate breaker bar 52 disposed between first and second adjustable linkages 54 and 56. Linkages 54 and 56 are disposed on opposite lateral sides of floor panel 36 as will be described in more detail below. Said linkages may be seen to effectively permit both the height and the lateral adjustment of breaker bar 52 relative to rear wall 30 and front wall 40 to therein provide precise adjustability.

Figure 2:
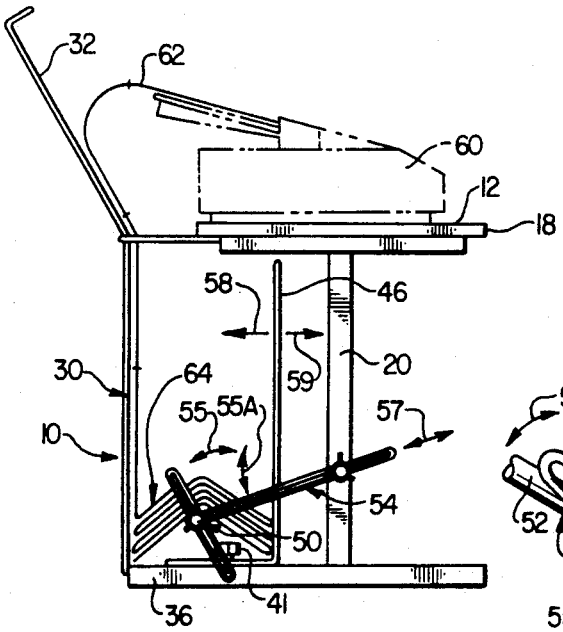
FIG. 2 is a side elevational view of the paper collection structure of FIG. 1 illustrating the folding of the continuous feed paper therein.

Referring now to FIG. 2 there is shown a side-elevational view of the collection basket 10 and printer stand 12 of FIG. 1. A conventional printer 60, shown in phantom, is illustrated resting atop panel 18 with continuous feed paper 62 being discharged therefrom. It may be seen in this particular illustration that backwall section 32 engages the paper 62 as it arches over the rear portion of the printer and is directed downwardly toward the lower region of the basket 10. The rear wall 30 of the collection basket 10 guides the paper 62 downwardly toward the bottom panel 36 where the paper is folded into stack 64. The folding of the paper in stack 64 occurs across the breaker bar 50, the position of which is controlled by the linkages 54 and 56 to be described hereafter. As illustrated in FIG. 2 the linkages 54 and 56 adjust the breaker bar by moving in the direction of arrows 55, 55A and 57. Likewise, the frontal wall 40 may be adjusted in the direction of arrows 58 and 59 to precisely define the lateral size of the collection basket 10 for receipt of the paper 62 from the printer 60 disposed thereabove. It may also be seen in this view that frontal wall securement means 41 is likewise illustrated from a side elevational view further showing the securement of the base section of frontal wall 40 for proper securement of the folded paper 64 therein.

Figure 3:
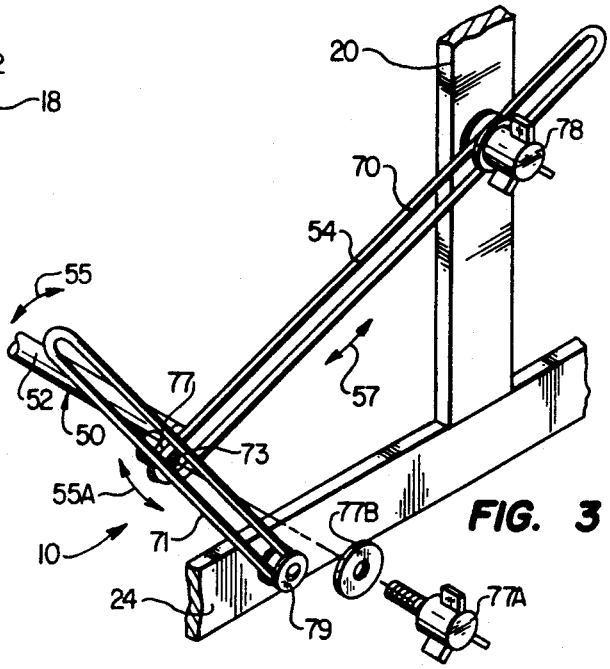
FIG. 3 is an enlarged, fragmentary, side elevational view of the collection structure of FIG. 2 illustrating in more detail the means for passively folding the paper therein and the adjustability thereof.

Referring now to FIG. 3 there is shown an enlarged side-elevational, fragmentary view of the breaker bar 50 of the collection basket 10 and the positioning linkage 54 thereof. The linkage 54 includes a first lateral adjustment member 70 which is coupled at a first end to leg 20 and slidably engaged at a second end to vertical linkage member 71. The engagement between linkage members 70 and 71 is in association with the breaker bar 50, which has a threaded end section 73 created by the securement of a T-Nut 77 thereto. In the present embodiment, the breaker bar 50 is welded to the linkage member 70 and T-nut 77 is likewise welded thereon. In this regard, it may be seen that linkage members 70 and 71 are each comprised of elongate wire members formed by bending or the like into elongated loops. The threaded section 73 of T-Nut 77 is axially aligned between the sides of linkage members 70 and 71 as shown in the drawings. The securement of breaker bar 50 and T-Nut 77 relative to the angular engagement between linkage members 70 and 71 is thus seen to be effected by a threaded fastener, such as ¼-20 knob bolt 77A with washer 77B shown for reference purposes. The knob bolt 77A extends through washer 77B and into threaded section 73 of T-nut 77 to sandwich linkage member 71 between it and linkage member 70. The same assembly of knob bolt 77A with a T-nut and linkage assembly 56 is utilized on the other end of breaker bar 50. In this manner, the angular relationship between linkage members 70 and 71 and the resulting lateral and height position of the breaker bar 50 may be rigidly secured.

In operation, the lateral position of linkage member 70 is first secured relative to leg 20. This lateral securement of linkage member 70 is provided by another knob bolt 78 which engages a T-nut (not shown) mounted within the leg 20. The knob bolt 78 then extends through the loop of linkage member 70 into the recessed T-nut for securement in the manner shown for knob bolt 77. In this manner it may be seen that linkage member 70 may slide beneath knob bolt 78 and pivot thereabout. In similar manner, linkage 71 pivots about base member 24 across pivot mounting 79. The mounting 79 is not adjustable in this particular embodiment, simply providing a point upon the leg 24 allowing linkage member 71 to arcuately move in the direction of arrow 55. No height, or vertical, adjustment is facilitated, due to the fact that breaker bar 50 may slide upwardly and downwardly within the loop of linkage member 71. Arrow 55A illustrates the arcuate movement of the linkage member 70 about pivot point 78 while arrow 57 illustrates the lateral movement afforded thereby. It may be seen with such adjustability that the position of breaker bar 50 within the basket 10 can be precisely located for the most appropriate folding of paper thereover. The same adjustment assembly is provided in the linkage 56 oppositely disposed from linkage 54.

Figure 4:
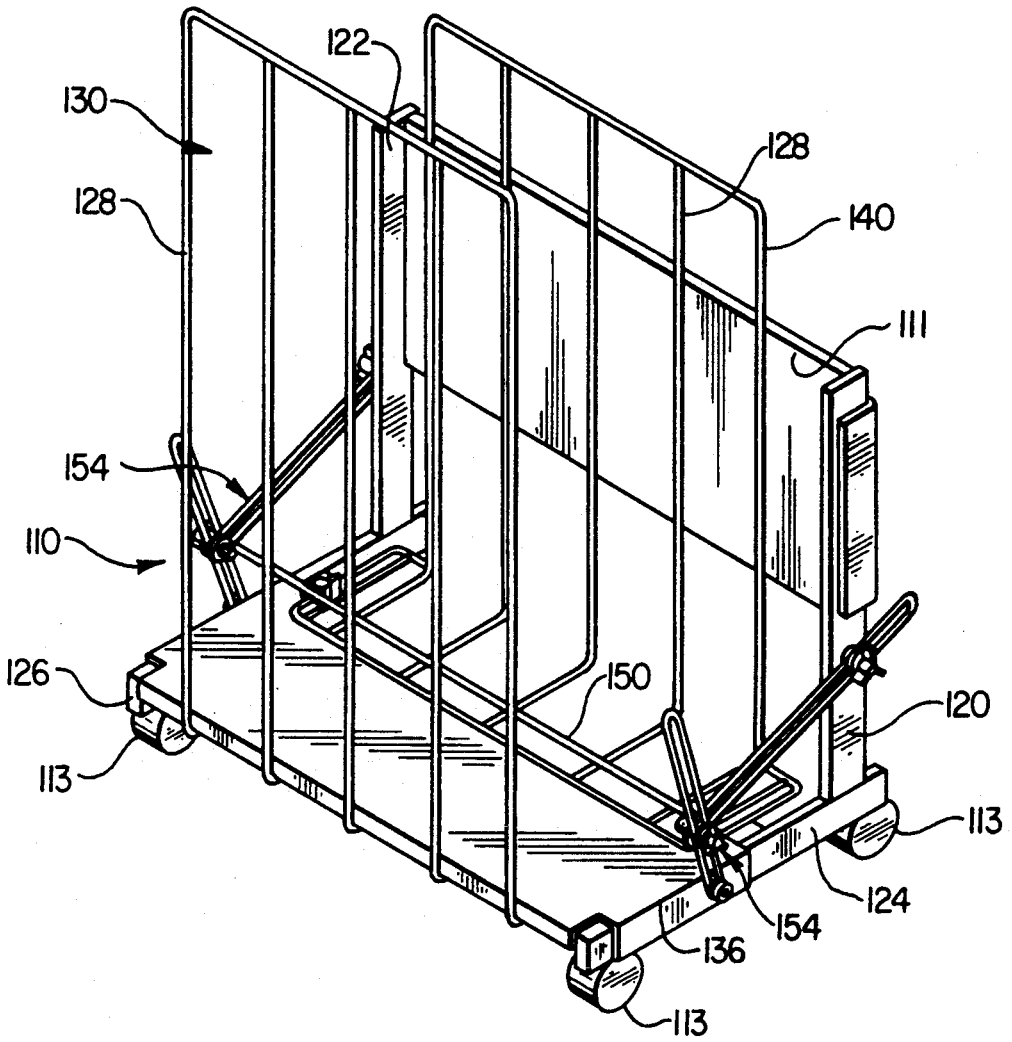
FIG. 4 is a perspective view of an alternative embodiment of the printer paper collection structure separately formed for positioning adjacent a printer stand.

Referring now to FIG. 4, there is shown an alternative embodiment of the collection basket 10 of the present invention. A portable collection basket 110 shown in FIG. 4 comprises a frontal wall 130 formed out of a plurality of wire members 128. The frontal wall 130 is disposed oppositely, and in a generally parallel spaced relationship with, a second wall 140 likewise comprised of wire members 128. The walls. 130 and 140 are disposed about a base member 136 that is itself mounted to a frame having bottom leg members 124 and 126 and upstanding leg members 122 and 124, respectively. It may be seen that portable collection basket 110 is not assembled directly to a printer stand 12, as shown in FIGS. 1-3, but instead, provides a separate assembly that is yet fully adjustable with a breaker bar 150 that may be disposed adjacent a variety of printers and printer stands not having a self-contained stacking region.

Still referring to FIG. 4, it may be seen that the position of the breaker bar 150 is effected exactly as described above in that a linkage assembly 154 controls the position of breaker bar 150 as described in FIG. 3. For structural purposes a separate, solid wall panel 111 may be disposed adjacent wall 140 and secured to upstanding leg members 120 and 122 as shown herein. The collection basket 110 may there be positioned directly upon a floor, upon a printer stand base, or it may be constructed with casters 113 as shown herein. The casters 113 permit the collection basket 110 to be rolled into and out of position relative to a printer stand.

In operation, the collection baskets 10 and 110 described above may be positioned beneath a variety of continuous feed paper printers and may be utilized to adjustably fold either standard computer paper, forms or labels secured thereto in a variety of sizes. Size may be accommodated by the adjustable wall members described herein as well as the adjustable breaker bar fully described above. Because the collection basket 110 may be separately formed, its utilization with casters 113 will allow it to be rolled from one printer stand to another for ease in handling, and it may easily facilitate the collection of paper from a variety of printers with a few minor adjustments of the type described above.

It is thus believed that the operation and construction of the present invention will be apparent from the foregoing description. While the method, apparatus and system shown and described has been characterized as being preferred, it will be readily apparent that various changes and modifications can be made therein without departing from the spirit and scope of the invention as defined in the following claims.

What is claimed is:

1. An improved printer stand of the type comprising a first platform adapted for supporting a printer, a leg assembly and base supporting said platform, and means for passing continuous feed printer paper discharged from said printer downwardly toward said base, the improvement comprising:

a paper chute disposed adjacent said platform and angled downwardly toward said base;

a tray assembly disposed relative to said leg assembly and beneath said paper chute for collecting said paper from said chute;

means disposed within said tray for inducing said paper to fold upon itself and stack therein;

said folding means comprising at least one bar adjustably mounted within said tray for select positioning relative to said leg assembly and beneath said platform;

said bar being supported on opposite ends by adjustable linkage affording height and lateral position adjustment thereof; and wherein said adjustable linkage comprises first and second slotted arms, said arms being pivotally engaged one to the other on a first end of each and opposite ends of said first and second arms being pivotally secured to laterally disposed portions of said leg assembly.

2. An improved printer paper collection basket of the type wherein a container is disposed beneath a continuous feed paper printer platform for receipt of paper discharged therefrom, the improvement comprising first and second upstanding walls adjustably disposed one to the other for facilitating the size of paper to be received from said printer and means disposed between said adjustable walls for inducing said paper to fold upon itself and stack therein;

said folding means comprising at least one bar adjustably mounted between said walls for select positioning relative thereto and beneath said platform, and wherein said bar being supported on opposite ends by adjustable linkage affording height and lateral position adjustable thereof; and wherein said adjustable linkage comprises first and second slotted arms, said arms being pivotedly engaged one to the other on a first end of each and opposite ends of said first and second arms being pivotedly secured to laterally disposed portions of said basket.

3. The apparatus as set forth in claim 2 and further included wherein said walls are formed of wire members upstanding from a base portion therebelow, at least one of said wire members being slidable along said base portion for adjustment relative to said first wall.

4. A printer stand for supporting a printer having a continuous feed paper discharge, said printer stand comprising:

a platform adapted for receipt of a printer thereon;

a leg assembly underlying said platform for supporting said printer thereabove, said leg assembly including a base for establishing stability of said platform;

a paper chute in association with said platform for channeling paper from said printer to said base;

means associated with said base for collection of said paper from said printer disposed thereabove;

means associated with said collection means for imparting select folding to said printer paper as it is received within said collection means;

wherein said collection means comprises an adjustable wall adapted for defining a space particularly contoured to the size of said printer paper;

said folding means comprises a bar disposed within said collection means adapted for engaging said printer paper intermediately thereof and imparting an arcuate rest configuration thereupon and the folding thereof; and wherein said bar is supported within said collection means by at least one pivotal linkage adapted for select height and width adjustment of said relative to said collection means.

5. The apparatus as set forth in claim 4 wherein said adjustment means comprises first and second pivotal linkage, said first linkage being pivotally connected to said leg assembly and one end of said second linkage being pivotally connected to said base, said first and second linkages being pivotally connected at opposite ends thereof to each other for select angular adjustment therebetween.

6. A paper collection basket for receiving, folding and stacking continuous feed paper discharged from a printer disposed thereabove, said basket comprising first and second wall panels oppositely disposed one to the other defining a lateral width size to permit receipt of said continuous feed paper therein, and means disposed within said basket between said wall panels for inducing said paper to fold upon itself and stack therein during discharge from said printer disposed thereabove;

said folding means comprises at least one bar adjustably mounted within said basket for select positioning relative to said first and second wall panels and beneath said platform;

wherein said bar is supported on opposite ends by adjustable linkage affording height and lateral position adjustment thereof; and wherein said adjustable linkage comprises first and second slotted arms, said arms being pivotedly engaged one to the other on a first end of each and opposite ends of said first and second arms of being pivotedly secured to laterally disposed portions of said collection basket.

7. The apparatus as set forth in claim 6 wherein one of said wall panels is adjustable relative to the other for defining one side of said collection basket and accommodating different sizes of continuous feed paper received therein.

8. The apparatus as set forth in claim 6 wherein said wall panels are each comprised of upstanding wire members connected along the top thereof for forming a substantially plainer wall section adapted for containing the continuous feed paper received therein.

9. The apparatus as set forth in claim 6 wherein said collection basket further includes a bottom tray section, said tray section having secured thereto a plurality of underlying casters facilitating the mobility of said collection basket relative to said printer.

* * * * *